US005564782A

United States Patent [19]

LaGrange et al.

[11] Patent Number: 5,564,782

[45] Date of Patent: Oct. 15, 1996

[54] PROTECTIVE GUARD FOR ROCKING CHAIR ROCKER ENDS

[76] Inventors: Avis A. LaGrange; Dwayne M. LaGrange, both of 294 Trailsway Dr., Hahnville, La. 70057

[21] Appl. No.: 382,882

[22] Filed: Feb. 2, 1995

[51] Int. Cl.[6] ..... A47C 3/029

[52] U.S. Cl. ..... 297/272.4; 297/272.1; 248/345.1

[58] Field of Search ..... 297/272, 258, 297/463.2; 248/345.1, 188.9, 615

[56] References Cited

U.S. PATENT DOCUMENTS

| | | | |
|---|---|---|---|
| 1,233,006 | 7/1917 | Weishaar | 297/272 |
| 3,306,662 | 2/1967 | Finnigan | 297/482 |
| 3,796,430 | 3/1974 | Sudo | 272/70.3 |
| 3,848,922 | 11/1974 | Blanford . | |
| 3,957,282 | 5/1976 | Finnigan | 297/482 |
| 4,243,265 | 1/1981 | Hanik . | |
| 4,616,873 | 10/1986 | Debo | 297/272 |
| 4,693,495 | 9/1987 | LaPointe | 297/482 X |
| 5,108,152 | 4/1992 | Reilly et al. | 297/482 |

FOREIGN PATENT DOCUMENTS

| | | | |
|---|---|---|---|
| 3501747 | 9/1986 | Germany | 297/482 |

*Primary Examiner*—Peter R. Brown
*Attorney, Agent, or Firm*—Joseph N. Breaux

[57] ABSTRACT

A protective guard for use in conjunction with a rocking chair of the type having a pair of rocker members that terminate in sharp rocker-ends including a first and second guard member each having a cavity therein of a size sufficient to receive therein one of the rocker ends and a portion of one of the rocket members; and a horizontal guard member in connection between the first and second guard members in a manner to span a gap between a pair of rocker members. The protective guard may includes a cover member, constructed of a flexible, cleanable material, having a compartment therein in connection with a first and second cover opening. The first, second and horizontal guard members are disposed within the compartment in a manner such that the first and second cavity openings are, respectively, insubstantial registration with the first and second cover openings.

12 Claims, 3 Drawing Sheets

PROTECTIVE GUARD FOR ROCKING CHAIR ROCKER ENDS

TECHNICAL FIELD

The present invention relates to devices for preventing injuries to children and pets from sharp objects and more particularly to devices for preventing injuries to children and pets from the sharp terminal points of the rocker member(s) of a rocking chair.

BACKGROUND ART

Small children and pets spend a large portion of their time near the floor surface crawling and playing. Because they spend so much time near the floor surface, it is desirable to guard them from injuries from sharp objects located near the floor. One of the more common sharp objects that may cause injuries to small children and pets is the sharp terminal points of a rocking chair's rocker members. These terminal points are usually positioned between two and five inches above the floor surface at a level about even with the eyes of a crawling child or walking animal. It would be desirable, therefore, to have a device for covering these sharp terminal points with a cushioned material which would prevent injuries to small children and pets who may inadvertently contact them when crawling or playing. It would also be desirable, to prevent crushing injuries to small children and pets, if the device prevented small children and pets from crawling between the rocker members of the rocking chair.

GENERAL SUMMARY DISCUSSION OF INVENTION

It is thus an object of the invention to provide a device that may be placed over the terminal points of the rocker members of a rocking chair.

It is a further object of the invention to provide a device which may be placed over the terminal points of the rocker members of a rocking chair, and which includes a horizontal member extending between the terminal points of the rocker members to provide a barrier to prevent small children and animals from positioning themselves between the rocker menders.

Accordingly, a protective guard for use in conjunction with a rocking chair of the type having a pair of rocker members that terminate in sharp rocker-ends is provided. The protective guard comprises: a first and second guard member each having a cavity therein of a size sufficient to receive therein one of the rocker ends and a portion of one of the rocker members; and a horizontal guard member in connection between the first and second guard members in a manner to span a gap between a pair of rocker members. The first and second guard members are preferably constructed of a flexible material that will hold its shape but which will provide sufficient padding to cushion the impact between a child or pet and the sharp terminal point of the rocker member; and more preferably are constructed from foam rubber.

The protective guard preferably includes an attachment mechanism in functional connection with the firsthand second guard members for detachably securing the protective guard to the rocking chair. The term "functional connection" is used herein to mean any mechanical linkage whether directly between the guard members and the rocking chair or indirectly between another part of the protective guard and the rocking chair which allows the first and second guard members to be detachably secured over the terminal points of a rocking chair.

In a preferred embodiment, the protective guard further includes a cover member, constructed of a flexible, cleanable material, having a compartment therein in connection with a first and second cover opening. The first, second and horizontal guard members are disposed within the compartment in a manner such that the first and second cavity openings are, respectively, in substantial registration with the first and second cover openings. The term "substantial" registration is used herein to mean oriented in a manner sufficient to allow a terminal point of a rocker member to be inserted through the compartment opening, through the cavity opening and into the cavity.

The cover member preferably includes an attachment mechanism in connection therewith for detachably securing the protective guard to the rocker members; and more preferably includes a first and second band of elastic material respectively attached adjacent the first and second cover openings.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
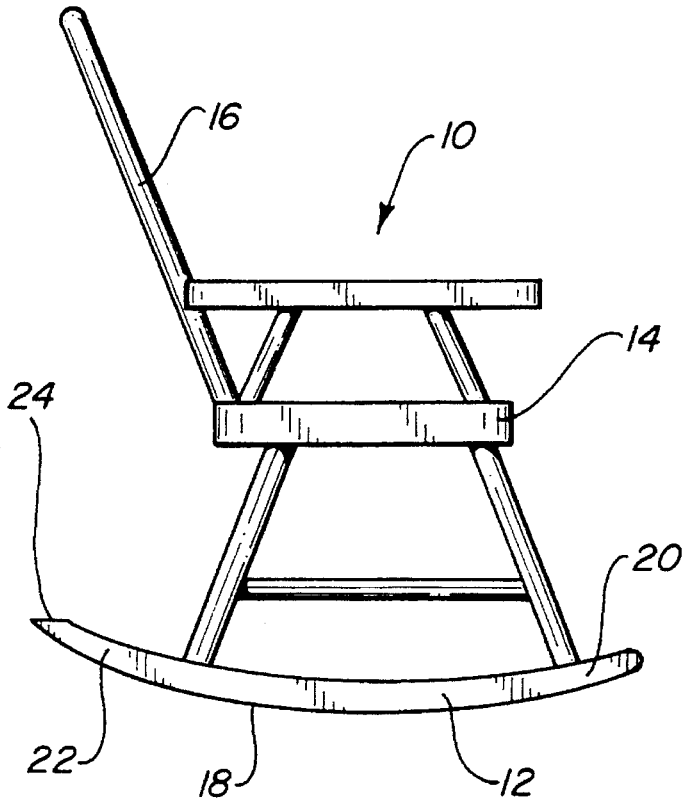
FIG. 1 is a side view of a representative rocking chair of the type having a pair of rocker members.

FIG. 1 shows a representative rocking chair 10 of the type which the protective guard of the invention may be used. Rocking chair 10 includes a pair of parallel rocking members 12, a seat member 14, and a back rest member 16. Each rocking member 12 has a curved bottom section 18, a front rocker-end 20 and a rear rocker-end 22. Each rear rocker-end 22 has a sharp terminal point 24.

Figure 2:
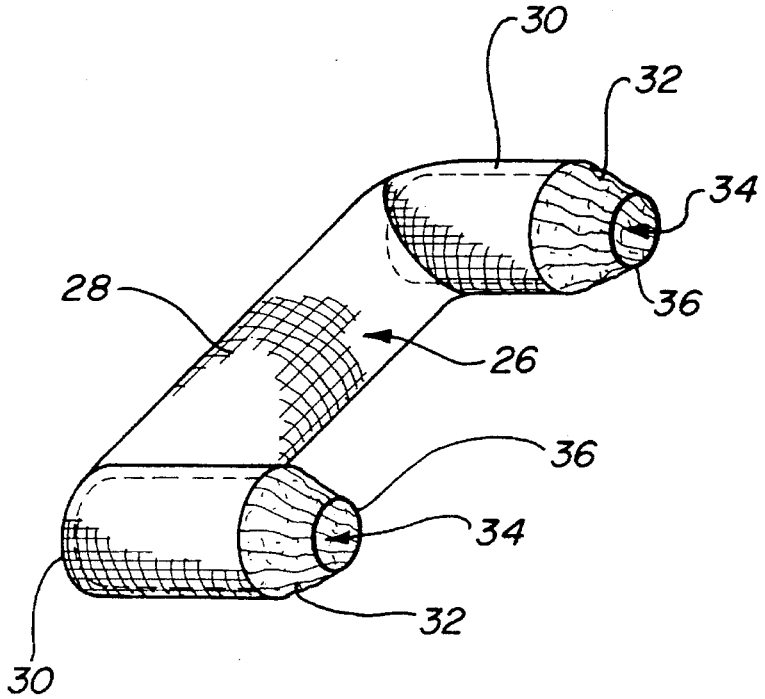
FIG. 2 is a perspective view of an exemplary embodiment of the protective guard of the invention.
Figure 3:
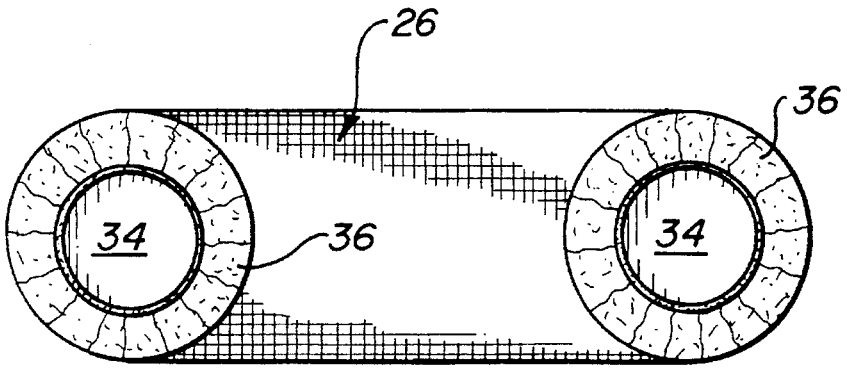
FIG. 3 is a side view of the protective guard of FIG. 2 showing the sleeve apertures.

FIG. 2 shows an exemplary embodiment of the protective guard of the invention generally designated by the numeral 26. Protective guard 26 includes a protective cover 28 enclosing a foam insert comprising a horizontal guard member, and two terminal point guards (shown in FIG. 3A). Protective cover 28 is constructed of cotton fabric and has two right angled portions 30 at either end that cover the terminal point guards. Each right angled portion 30 terminates in a flexible sleeve 32 that extends past the end of the terminal point guard. Flexible sleeves 32 terminate in sleeve apertures 34 that are defined by elastic bands 36. In use, elastic bands 36 are stretched to fit over rocker-ends 20,22 and released to frictionally secure protective guard 26 in place. FIG. 3 more clearly shows sleeve apertures 34 and elastic bands 36.

Figure 3A:
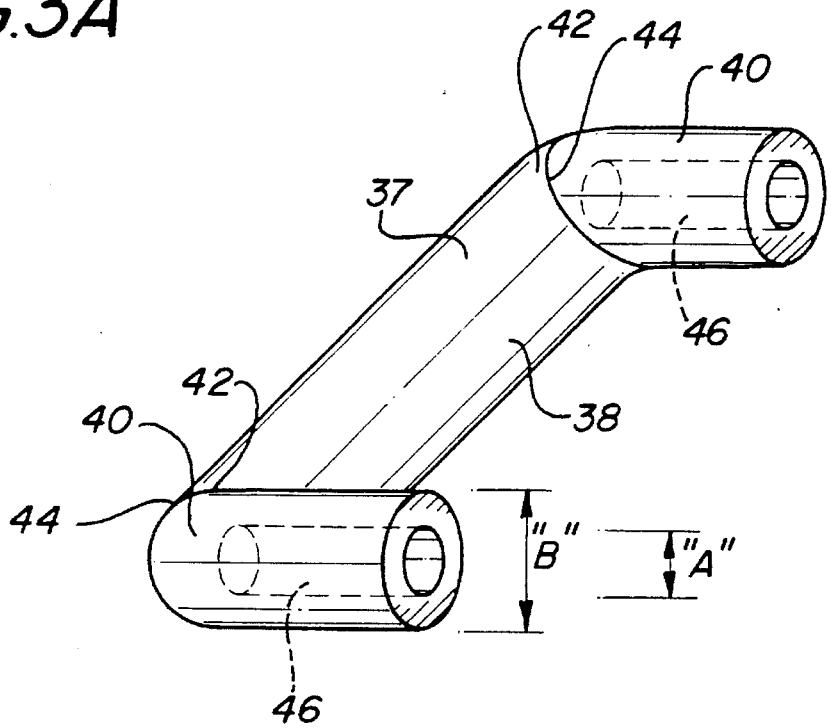
FIG. 3A is a perspective view of the foam insert of the exemplary embodiment of the protective guard shown in FIG. 2.

FIG. 3A shows a foam insert 37 with protective cover 28 removed. As described before, foam insert 37 includes a horizontal guard member 38 and two terminal point guards 40. Horizontal guard member 38 is an 18" length of circular cross-section, foam having a diameter of about 4". Each end 42 is cut at about a 45 degree angle to facilitate connection of terminal point guards 40.

Each terminal point guard 40 is constructed of a 6" length of tubular cross-section, foam having an internal diameter "A" of about 2" and an outer diameter "B" of about 4". One end 44 of each terminal point guard 40 is cut at an angle of about 45 degrees to facilitate connection with horizontal guard member 38. Terminal point guards 40 and horizontal guard member 38 are adhesively connected to form two guard cavities 46 having a depth of about 4" and a diameter of about 2".

Figure 4:
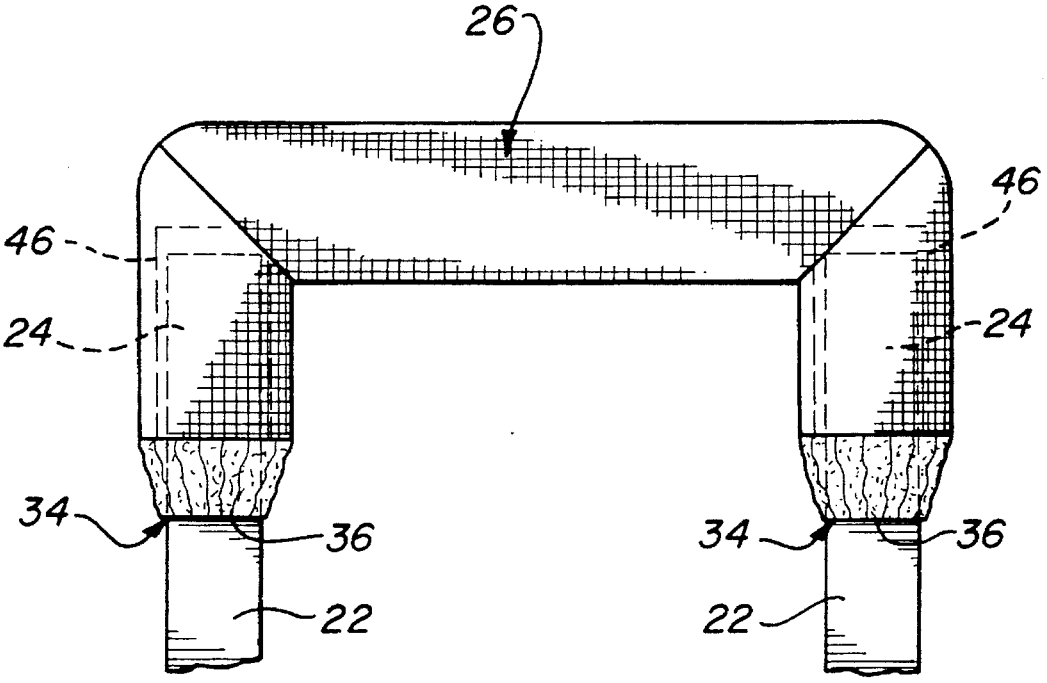
FIG. 4 is a partial top view showing the terminal points of the rocker members installed within the guard cavities of the protective guard.

FIG. 4 illustrates the use of protective guard 26 and shows the terminal points 24 of rear rocker-ends 22 installed within guard cavities 46 of protective guard 26 through sleeve apertures 34. Protective guard 26 is held in place by elastic bands 36 which are secured about rear rocker ends 22. Installation of terminals points 24 within guard cavities 46 places at least a 2" thick foam barrier between a child or small animal and sharp terminal points 24 and thereby prevents injuries caused by inadvertent contact therewith.

Figure 5:
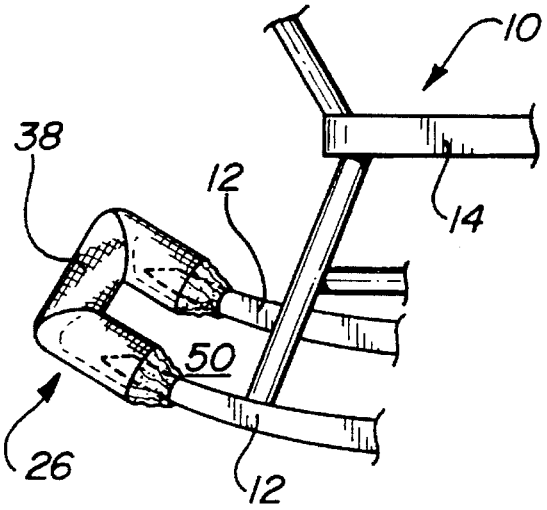
FIG. 5 is a partial perspective view showing the protective guard installed over and between the terminal points of the rocker members of the representative rocking chair of FIG. 1.

FIG. 5 illustrates how horizontal guard member 38 of protective guard 26 blocks the access path to a gap 50 formed between rocking members 12 of rocking chair 10. The presence of horizontal guard member 38 serves to deter small children and animals from positioning themselves under seat member 14 and prevents them from becoming inadvertently injured by someone sitting and/or rocking in rocking chair 10.

It can be seen from the preceding description that a protective guard that may be placed over the terminal points of the rocker members of a rocking chair that includes a horizontal member extending between the terminal points of the rocker members to provide a barrier to prevent small children and animals from positioning themselves between the rocker members has been provided.

It is noted that the embodiment of the protective guard described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A protective guard for use in conjunction with a rocking chair of the type having a pair of rocker members that terminate in sharp rocker-ends, the protective guard comprising:

a first guard member having a first longitudinal axis, a first cavity therein and a first cavity opening in connection with said first cavity, said first cavity being of a size sufficient to receive therein one of said rocker ends and a portion of one of said rocker members;

a second guard member having a second longitudinal axis oriented substantially parallel to said first longitudinal axis of said first guard member having a second cavity therein, separated from said first cavity, and a second cavity opening in connection with said second cavity, said second cavity being of a size sufficient to receive therein one of said rocker ends and a portion of one of said rocker members; and a horizontal guard member in connection between and perpendicular to said first and second guard members and of a length sufficient to allow said horizontal guard member to span a gap between a pair of rocker members and provide a barrier between said first and second cavities and a barrier between said rocker members.

2. The protective guard of claim 1, further including:

a cover member, constructed of a flexible, cleanable material, having a compartment therein in connection with a first and second cover opening; and wherein:

said first, second and horizontal guard members are disposed within said compartment in a manner such that said first and second cavity openings are, respectively, in substantial registration with said first and second cover openings.

3. The protective guard of claim 2, wherein:

said cover member includes means in connection therewith for detachably securing said protective guard to said rocker members.

4. The protective guard of claim 3 wherein:

said means includes a first and second band of elastic material respectively attached adjacent said first and second cover openings.

5. The protective guard of claim 2, wherein:

said cover member includes means in connection therewith for detachably securing said protective guard to said rocker members.

6. The protective guard of claim 5, wherein:

said horizontal guard member is constructed of a plastic material.

7. The protective guard of claim 6, wherein:

said plastic material is a foam type material.

8. The protective guard of claim 1 further including:

first means in functional connection with said first guard member for detachably securing said first guard member to one of said rocker members; and second means in functional connection with said second guard member for detachably securing said second guard member to one of said rocker members.

9. The protective guard of claim 8 wherein:

said means includes a first and second elastic band.

10. The protective guard of claim 1 wherein:

said first and second guard members are constructed of a plastic material.

11. The protective guard of claim 10, wherein:

said horizontal guard member is constructed of a plastic material.

12. The protective guard of claim 10, further including:

a cover member, constructed of a flexible, cleanable material, having a compartment therein in connection with a first and second cover opening; and wherein:

said first, second and horizontal guard members are disposed within said compartment in a manner such that said first and second cavity openings are, respectively, in substantial registration with said first and second cover openings.

* * * * *